US007290836B2

(12) United States Patent
Nordstrom et al.

(10) Patent No.: US 7,290,836 B2
(45) Date of Patent: Nov. 6, 2007

(54) PATIENT CHAIR

(75) Inventors: Carl G. Nordstrom, Lake Oswego, OR (US); Edward R. Jacobs, Salem, OR (US); Mathew H. Parlier, Sheridan, OR (US); Craig J. Beard, McMinnville, OR (US); Kenneth E. Mattocks, Newberg, OR (US); Christopher C. Stone, Newberg, OR (US)

(73) Assignee: A-dec, Inc., Newberg, OR (US)

( * ) Notice: Subject to any disclaimer, the term of this patent is extended or adjusted under 35 U.S.C. 154(b) by 398 days.

(21) Appl. No.: 10/855,031

(22) Filed: May 26, 2004

(65) Prior Publication Data

US 2005/0046265 A1 Mar. 3, 2005

Related U.S. Application Data

(60) Provisional application No. 60/498,918, filed on Aug. 28, 2003.

(51) Int. Cl.
*A47C 7/46* (2006.01)

(52) U.S. Cl. ..... 297/452.36; 297/440.2; 297/452.31

(58) Field of Classification Search ..... 297/452.14, 297/452.31, 452.32, 452.33, 452.36, 452.55, 297/440.2, 440.21, 452.61, 452.65
See application file for complete search history.

(56) References Cited

U.S. PATENT DOCUMENTS

| | | | | |
|---|---|---|---|---|
| 1,685,599 A | | 9/1928 | Fletcher | |
| 2,172,063 A | | 9/1939 | Hara | |
| 2,278,890 A | | 4/1942 | May | |
| 2,449,385 A | | 9/1948 | Johnson et al. | |
| 2,832,397 A | | 4/1958 | Premo | |
| 3,177,036 A | | 4/1965 | Halter | |
| 3,596,982 A | | 8/1971 | Grams | |
| 3,713,697 A | | 1/1973 | Koepke | |
| 3,722,950 A | * | 3/1973 | Harnick | 297/218.1 |
| 3,819,232 A | | 6/1974 | Wagner | |
| 3,860,286 A | | 1/1975 | Rasmussen | |
| 3,968,990 A | | 7/1976 | Heubeck | |
| 4,000,925 A | | 1/1977 | Doerr et al. | |

(Continued)

FOREIGN PATENT DOCUMENTS

DE 3125312 1/1983

(Continued)

OTHER PUBLICATIONS

New Scandinavian Technology.

*Primary Examiner*—Peter R. Brown
(74) *Attorney, Agent, or Firm*—Klarquist Sparkman, LLP

(57) ABSTRACT

A back for a patient chair having a back shell with a substantially rigid central S-shaped central portion and laterally extending wing portions which have sufficient flexibility to allow deflection in the direction of the front surface upon imposition of a force. The back consists of a formed back shell, a cushion layer laid thereover and an upholstery layer covering the cushion, with the upholstery layer adhered to the cushion and having edge margins wrapped around the outer edge margins of the cushion. The cushion and upholstery material are secured to the back shell through adhesive applied between the wrapped over edge margin portions of the upholstery material and the back shell.

34 Claims, 4 Drawing Sheets

U.S. PATENT DOCUMENTS

| | | | | | |
|---|---|---|---|---|---|
| 4,007,962 | A | | 2/1977 | Müller-Deisig | |
| 4,032,190 | A | | 6/1977 | Müller-Deisig et al. | |
| 4,099,774 | A | * | 7/1978 | Sandham | 297/298 |
| RE29,811 | E | | 10/1978 | Norris | |
| 4,377,308 | A | | 3/1983 | Pisanu | |
| 4,500,137 | A | | 2/1985 | Morehouse | |
| 4,556,254 | A | | 12/1985 | Roberts | |
| 4,557,521 | A | | 12/1985 | Lange | |
| 4,639,042 | A | | 1/1987 | Lange | |
| 4,712,835 | A | | 12/1987 | Völkle | |
| 4,836,609 | A | * | 6/1989 | Hill | 297/452.55 |
| 5,007,678 | A | | 4/1991 | DeKraker | |
| D333,736 | S | | 3/1993 | Nordstrom | |
| 5,190,349 | A | | 3/1993 | Austin, Jr. et al. | |
| 5,286,083 | A | | 2/1994 | Mattison | |
| D347,946 | S | | 6/1994 | Nordstrom et al. | |
| D351,742 | S | | 10/1994 | Phleps et al. | |
| 5,403,067 | A | | 4/1995 | Rajaratnam | |
| D361,438 | S | | 8/1995 | Spencer et al. | |
| 5,489,145 | A | | 2/1996 | Van Hekken | |
| 5,520,441 | A | * | 5/1996 | Citton | 297/440.21 |
| 5,522,645 | A | * | 6/1996 | Dahlbacka | 297/452.55 |
| 5,577,811 | A | | 11/1996 | Ogg | |
| D378,961 | S | | 4/1997 | Nordstrom et al. | |
| 5,628,546 | A | | 5/1997 | Boetzkes | |
| 5,806,930 | A | | 9/1998 | Knoblock | |
| 5,836,653 | A | | 11/1998 | Albecker | |
| 5,842,264 | A | | 12/1998 | Roossien et al. | |
| 5,934,758 | A | | 8/1999 | Ritch et al. | |
| 5,992,934 | A | | 11/1999 | Gehrig et al. | |
| 6,027,171 | A | * | 2/2000 | Partington et al. | 297/452.18 |
| 6,155,647 | A | | 12/2000 | Albecker, III | |
| 7,032,971 | B2 | * | 4/2006 | Williams | 297/284.4 |
| 2003/0071503 | A1 | | 4/2003 | Brockway et al. | |
| 2005/0206212 | A1 | * | 9/2005 | Peterson | 297/452.32 |

FOREIGN PATENT DOCUMENTS

| | | |
|---|---|---|
| DE | 3710205 | 10/1987 |
| GB | 1377666 | 12/1974 |
| JP | 58109051 | 6/1983 |
| JP | 63130065 | 6/1988 |

* cited by examiner

FIG. 8
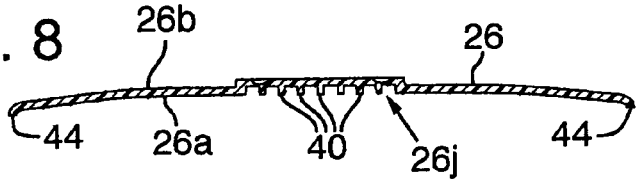
FIG. 9
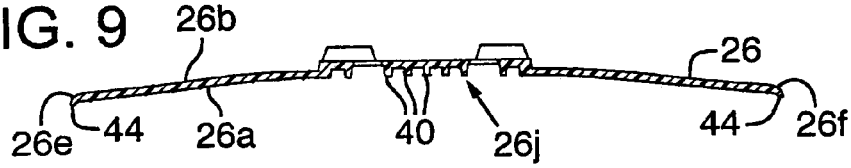
FIG. 10
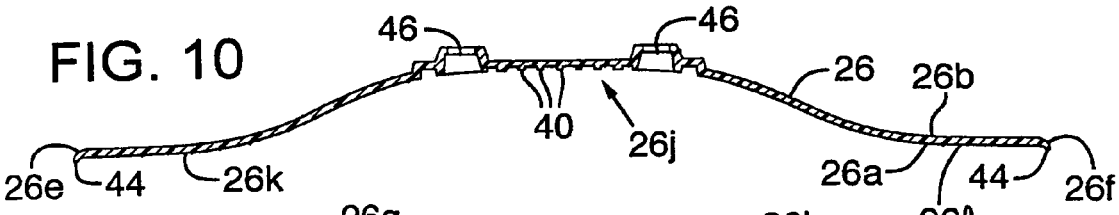
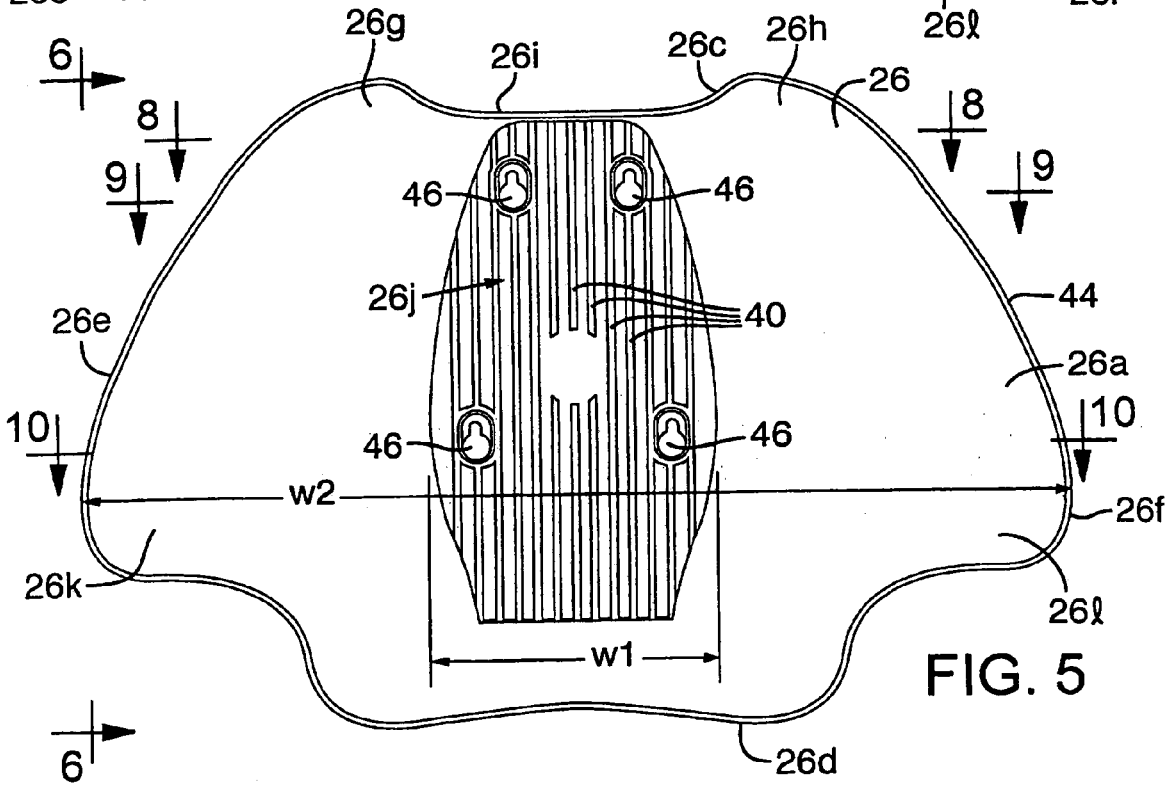
FIG. 5

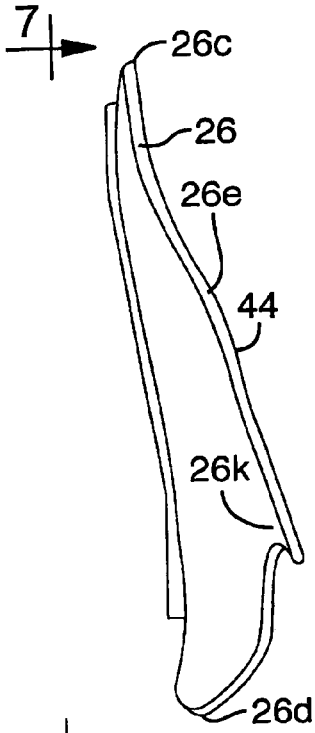
FIG. 6
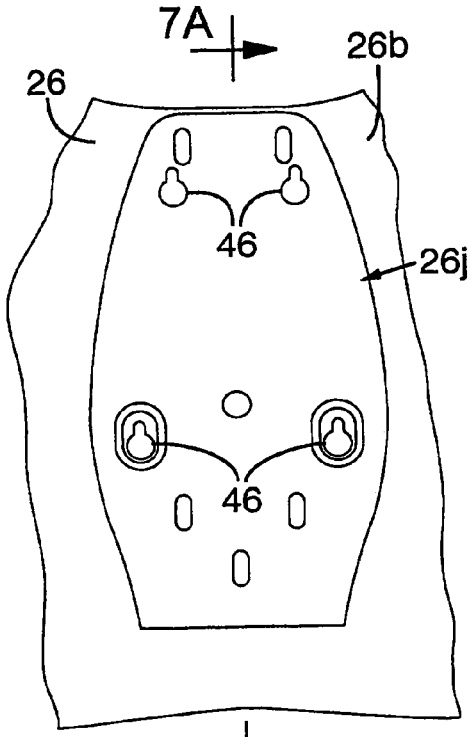
FIG. 7
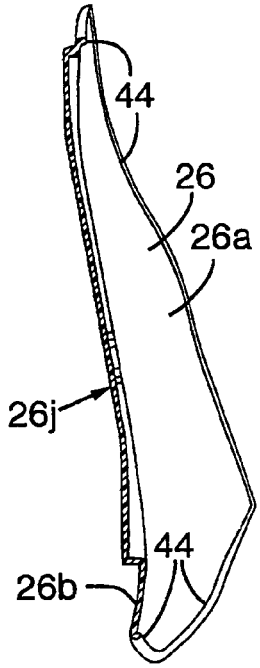
FIG. 7A
FIG. 11
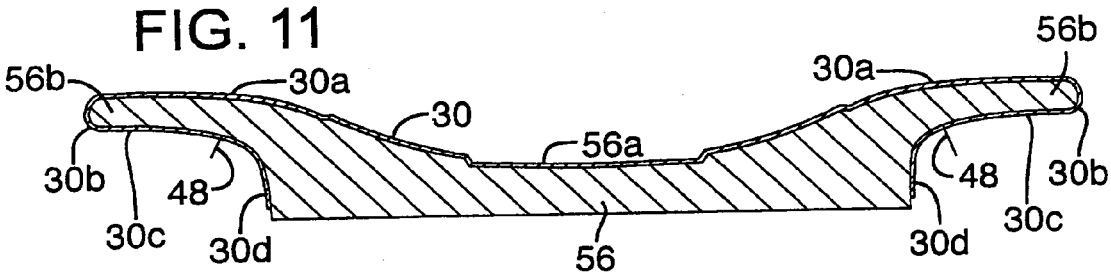
FIG. 12
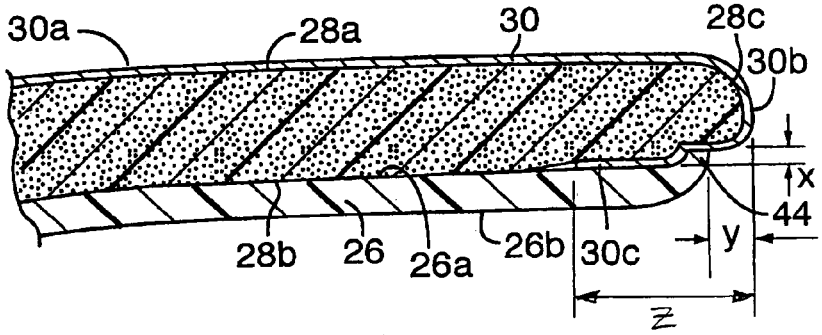

PATIENT CHAIR

CROSS REFERENCE TO RELATED APPLICATION

The present application claims priority from pending Provisional Pat. application Ser. No. 60/498,918, filed Aug. 28, 2003, which is incorporated herein by reference.

FIELD

This invention relates to patient chairs, and more particularly to a chair back which is comfortable for the patient and efficient for the operator.

BACKGROUND

Modern dental chairs include mechanism for raising and lowering the chair and tilting the back of the chair. The patient generally enters the chair when the chair is positioned with the back upright and with the seat elevated to permit comfortable entry. After the patient sits in the chair, the dentist or technician (hereafter operator), operates the chair to move the patient into a position selected by the operator which is most convenient for the procedure to be undertaken. For many procedures the chair back is tilted so that the patient assumes a more supine position.

Patient comfort is an important consideration. The chair should be configured so that the patient is comfortable irrespective of the chair position. Another important design consideration is that the operating position for the operator should be as convenient and efficient as possible for the operator.

In modern dentistry, the operator, whether it is a dentist or assistant, often will sit on a stool adjacent the back of the dental chair and the most convenient position to have the patient in is where the patient's head is as close to the operator's lap as possible. Thus it is helpful if the chair back is as thin as possible so that the operator's legs may be positioned under the back of the chair and minimal chair back thickness separates the operator's legs from the supine patient.

SUMMARY

This invention is directed to an improved patient chair, such as a dental chair, for enhancing patient comfort and operator's convenience.

As one aspect of the invention, the chair back is configured so that whenever the chair is moved into a supine position, the patient's back is comfortably supported.

The chair of the present invention is configured to provide a thin fore to aft cross-section to permit the patient to be reclined to a position closely adjacent the operator's lap for most convenient operator use.

Another aspect of the invention is to provide a chair back which has a substantially rigid central section to provide adequate patient back support, yet has side sections having sufficient flexibility to allow deflection of a side section in the direction of the front surface from a selected normal position by application of force imposed on the side section in a direction toward the front section and to return the side section to its normal position on release of force. This permits the chair back to be reclined to a position where a side section may engage an operator's legs and rest thereon, with the flexibility of the side section permitting the chair back to be lowered as needed and still not cause discomfort to the operator.

Another aspect of the invention is to provide such a chair back which is comprised of three layered elements to provide minimal thickness. These elements include a back shell, a cushion layer which overlies the back shell, and a molded upholstery covering which has outer marginal portions which wrap around the outer edges of the cushion layer and are adhered to the front side and marginal edge portions of the cushion layer and in turn are adhered to the back shell.

Yet another aspect of the invention is to provide a chair back which has top margin portions which are sufficiently high to provide good support for a patient's scapula, but which has a center top section which is depressed between such top margin portion to allow a headrest to be positioned therebetween.

In another aspect of the invention, an upper portion of the back rest has a generally straight across configuration, whereas a region of the back rest in a lower section has a generally trough-shaped central configuration to receive a patient's back in a comfortable position, and laterally extending side, or wing, portions which extend substantially perpendicular to the center line of the chair back to provide arm supports for a supine patient.

Another aspect of the invention is the provision of a method for producing a chair back in which a back shell is formed to a selected molded configuration with a selected front surface topographic contour and outer peripheral edge, a cushion of resilient material having a back surface configuration complementary to the face surface configuration of the back shell and an outer peripheral margin paralleling the outer peripheral edge of the back shell, and an upholstery layer overlying the front surface of the cushion material and having outer marginal edge portions which wrap around the outer edge margins of the cushion material and are adhesively secured to the back surface of the outer edge margins of the cushion material. Adhesive material applied between the wrapped around marginal edge portions of the upholstery material and the back shell secures the cushion and upholstery to the back shell. Thus a thin and cost efficient back for a patient chair is provided.

BRIEF DESCRIPTION OF THE DRAWINGS

FIG. 5 is an enlarged front elevation view of a back shell forming a portion of the chair;

FIG. 6 is a side elevation view taken generally along the line 6-6 in FIG. 5;

FIG. 7 is a rear view taken along the line 7-7 in FIG. 6 of a central section of the back shell;

FIG. 7A is a cross-sectional view taken generally along the line 7A-7A in FIG. 7;

FIGS. 8, 9 and 10 are cross-sectional views taken generally along the lines 8-8, 9-9 and 10-10, respectively, in FIG. 5;

FIG. 11 is a schematic illustrative view of a method for forming an upholstery cover for the device; and FIG. 12 is an enlarged view of an edge margin portion of the assembled chair back.

DETAILED DESCRIPTION

Figure 1:
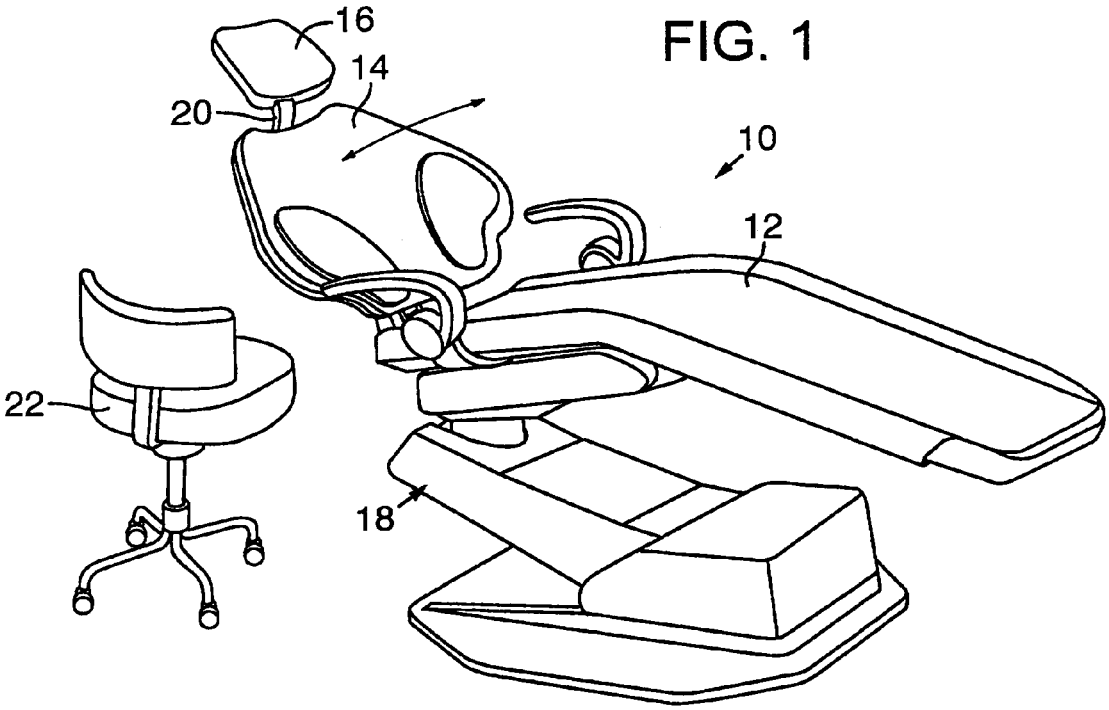
FIG. 1 is a perspective view of a patient's chair having a back according to an embodiment of the invention.
Figure 2:
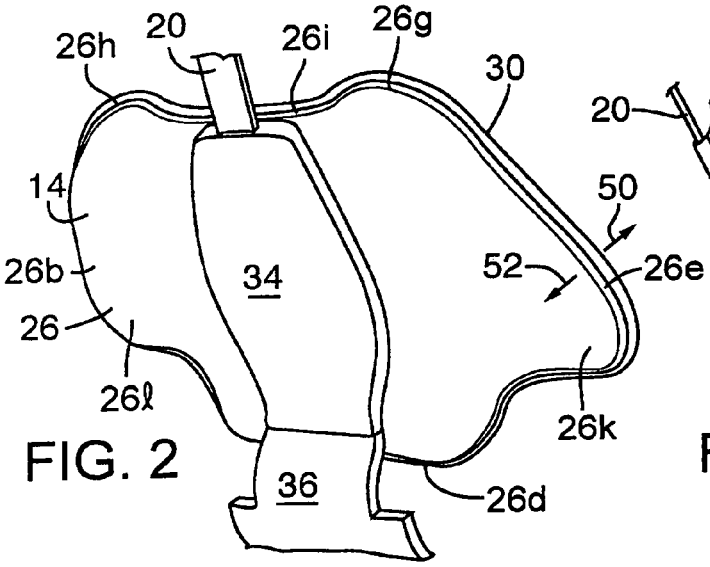
FIG. 2 is an enlarged rear perspective view of the chair back.
Figure 3:
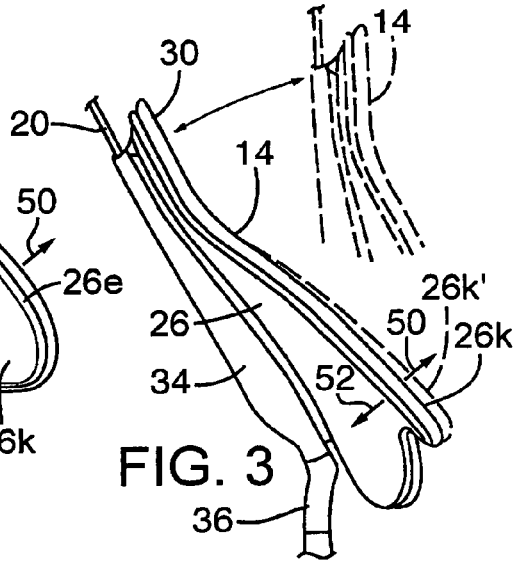
FIG. 3 is a side elevation view of the chair back.

Referring to the drawings, and first more specifically to FIG. 1, at 10 is indicated generally a patient chair, and more particularly, a dentist chair in which a patient would be supported during an operation or treatment. The chair includes a seat 12, back 14, head rest 16, and operating mechanism 18. The operating mechanism is capable of raising and lowering the chair and tilting the chair back from a substantially upright position, as shown in dashed out line in FIG. 3, to a more reclining, or supine, position as illustrated in FIGS. 1 and 3 in which the patient is in generally a laid back, or supine, position. The chair back actually may be tilted back farther than illustrated in FIGS. 1 and 3. The head rest 16, is mounted on a stem 20 which permits it to be slid up and down, toward and away from the top of back 14.

Also illustrated in FIG. 1 is an operator's stool 22 on which a dentist or dentist's assistant (the operator) would be seated adjacent chair 10. The operator would be seated such that their knees would be adjacent or under one side section of back 14 and upon lowering of the chair back to a convenient operator's position, the side section of the chair back may actually engage and press down a bit on the lap of the operator. This is to place the patient in a position which is as low as possible relative to the operator's lap to provide a more convenient and effective working position for the operator.

Figure 4:
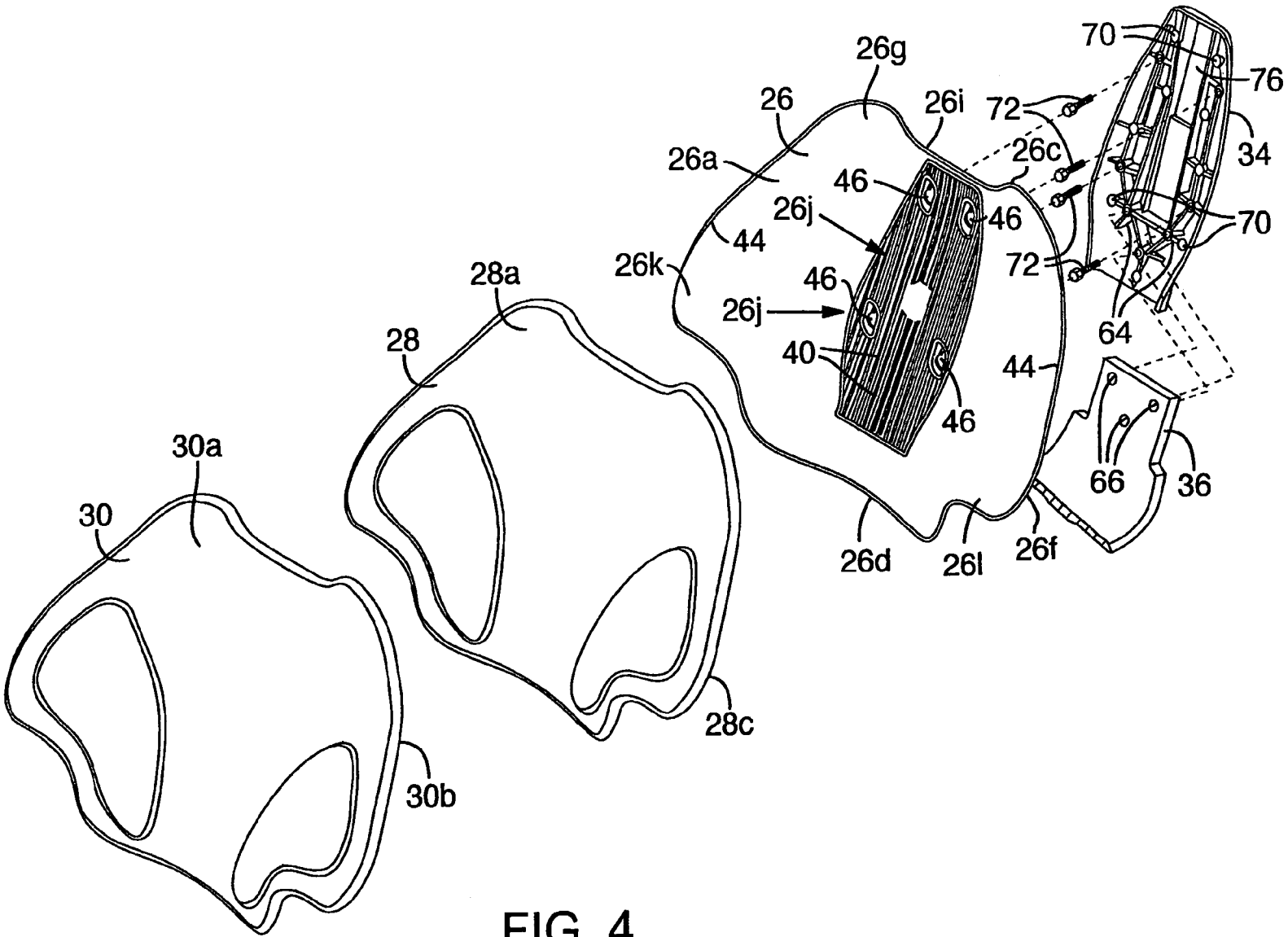
FIG. 4 is an exploded view of the component parts of the chair back and support therefore.

Referring to FIG. 4, the chair back includes three primary components. These are a back shell 26, a cushion layer 28, and an upholstery layer 30. The back is removably mounted on a support column 34 and the support column, in turn, is secured to a tilting arm 36 which is attached to and operated by the operating mechanism 18 of the chair to tilt, or rotate, the chair back between its upright and reclining positions.

Referring to FIGS. 5-10, the back shell 26 in the illustrated embodiment is a relatively thin molded plastic member having a front surface 26*a*, back surface 26*b*, top 26*c*, bottom 26*d*, and opposed outer sides 26*e*, 26*f*. The outer peripheral edge of the back shell has a selected outline as illustrated generally in FIG. 5.

The back shell has opposed top margin portions 26*g*, 26*h* which in the assembled product are high enough to comfortably support a patient's scapula. The center top section 26*i*, between top margin portions 26*g*, 26*h*, is depressed and has a width sufficient to receive head rest 16 therein so that the head rest may be lowered to a position close enough to the back to comfortably support a patient's head.

Explaining further, the chair back is designed to provide good support for patients in a wide range of heights and sizes. The scapula support region adjacent top margin portions 26*g*, 26*h* must be high enough on the back to align with the scapula region of a very tall patient. At the same time, the head rest must be allowed to be lowered sufficiently to align with the head of a very short patient. Thus the high scapula support regions adjacent top margin portions 26*g*, 26*h* provide scapula support for tall patients, while the depressed center top section 26*i* permits the head rest to be lowered to a position which will provide comfortable head rest for a short patient.

The back shell has a substantially rigid central section 26*j*. A plurality of substantially parallel elongate strengthening ribs 40 extend from a region adjacent the top of the back shell to a region adjacent the bottom of the back shell in central section 26*j*.

As seen in side view in FIG. 6, and in cross-section in FIG. 7A, the central, or median, portion of the back shell has a shallow gentle S-shaped configuration extending from top to bottom. This is to provide a comfortable configuration for supporting a user in the chair.

The back shell also has opposed side, or wing, sections 26*k*, 26*l* which extend laterally outwardly to opposite sides of central section 26*j* and are positioned to support a patient's arms when placed in a reclining position.

As viewed in section, as illustrated in FIGS. 8, 9 and 10, it will be seen that the back shell is substantially straight across near the top of the back shell (FIG. 8) and a short distance therebelow begins to curve into a shallow concave curvature on its front surface (as shown in FIG. 9).

In a region generally beginning at the mid-region of the chair and progressing downwardly therefrom, the back shell assumes a generally trough shaped configuration as illustrated in FIG. 10. The trough shaped portion of the chair back is contoured to comfortably receive a patient's back. Side sections 26*k*, 26*l* extend laterally outwardly in a substantially common plane disposed forwardly of the trough shaped center section and lie in a plane which is substantially perpendicular to the center line of the back shell.

The back shell preferably is formed as a one piece sheet-like member, such as by being molded from a synthetic resin material, preferably plastic, having desired properties of rigidity, elasticity and resiliency as required for the functions needed herein. The back shell preferably will be of relatively thin, but substantially uniform thickness throughout over a major portion of the back shell. In a preferred embodiment, the back shell is a broad functionally sculpted injection molded part which may be made of Valox 364 from General Electric averaging in a range of from 0.135 to 0.190 inch thick, preferably about 0.187 inch, to obtain the desired thinness and flexibility.

Extending fully about the peripheral outer edge of the back shell is a raised rim 44. The rim projects forwardly from the front surface 26*a* of the back shell a distance X as illustrated in FIG. 12. This distance X may be in a range of from 0.07 to 0.09 inch.

Formed into the backside of shell 26 are a plurality of keyhole-shaped receiving notches for receiving headed fasteners on support column 34, as will be described in greater detail below.

As previously discussed, the central section 26*j* is substantially rigid and has a shallow S-shaped configuration for providing substantial support for a patient's back. Side sections 26*k*, 26*l* are sufficiently flexible and resilient to allow deflection of a side section in the direction of the front surface from a selected normal position by application of force imposed on the side section and to return the side section to the normal position on release of such force. This is possibly best illustrated in FIG. 3. The back shell and its associated cushion and upholstery layers are shown in solid outline in FIG. 3 in what would be considered their normal, or at rest, position. The side sections (26*k* shown here) are flexible fore and aft, as illustrated by arrows 50, 52, when a force is imposed on the side section in one direction. Upon release of such force, the side section will return to its normal, at rest, position.

In use, when the chair back is pivoted to its reclined position and a side section may come into contact with an operator's leg, or lap, a force thus will be imposed on the side section in the direction of arrow 50 causing it to deflect forwardly to a position as illustrated in dashed outline at 26*k'* to permit the patient to be placed in the most convenient orientation for the operator and yet not to impose an uncomfortable force on the operator's legs.

As shown in FIG. 5, the central section of the back shell has a width indicated generally at W1 and has an overall width indicated at W2. W2 generally would be in excess of two times W1. As an example of the flexibility of side sections 26*k* and 26*l*, the back shell has sufficient flexibility that a side section, such as 26*k*, may be flexed forwardly in the direction of arrow 50, a distance of about 0.5 inch by an imposed force of 30 pounds.

The front, or face, surface 26*a* of back shell 26 has a selected topographic contour as shown in the figures.

Cushion 28, which is a layer of resilient material, is a preformed molded product. It is preformed to have a back surface topographic contour generally complementary to the topographic contour of the front surface 26*a* of the back shell so it will rest closely thereagainst. Cushion 28 also has a front surface topographic contour configured to provide comfortable support for a user. The front surface is indicated generally at 28*a* and the back surface at 28*b*. The cushion has an outer edge margin 28*c* with a peripheral edge configuration substantially parallel to the outer peripheral edge configuration outline of back shell 26, but slightly larger than the outline of the back shell. The dimensions of the cushion are such that the cushion material, when applied to the back shell, extends radially outwardly from all of the outer peripheral edges of the back shell by a distance Y as illustrated generally in FIG. 12. This distance Y may be in a range of from 0.25 to 0.5 inch, and more preferably in the illustrated embodiment at 0.5 inch.

The upholstery covering 30 may be of a relatively thin vinyl or upholstery shell material preformed to conform to the topographic contour configuration of front, or face, surface 28*a* of the cushion material. The upholstery layer has a face portion 30*a* and an edge margin portion 30*b* which is turned back to provide a portion 30*c* which may engage the backside 28*b* of cushion 28. The width of edge margin portion 30*c* is indicated at "Z" in FIG. 12, and may be in a range of about 0.5 to 4.0 inches.

The upholstery layer may be preformed of a vinyl material to have the general configuration illustrated in FIGS. 4 and 12. This preformed configuration may be provided by a method illustrated in FIG. 11. Here it is shown that a mold form 56 has a face surface 56*a* and outer edge portions 56*b* which conform generally to the configuration of cushion 28 on which the upholstery material is to be applied. The vinyl material is heated to soften such, then draped over mold form 56, and a vacuum is drawn through mold form 56 to cause material 30 to be drawn tightly against the form. The vinyl then is allowed to cool and set in the general configuration illustrated. The material is cut along lines 48 to produce rear margin portions 30*c* and waste portions 30*d* are cut therefrom and discarded.

The chair back is assembled by applying adhesive either to the front surface 28*a* of the cushion material and its edge margin portions 28*c*, or to all of the interior surfaces of upholstery material 30 which will engage cushion layer 28, or to both upholstery and cushion layer. The cushion layer then is inserted into the preformed upholstery material layer and adhered thereto about all of the inner surfaces of portions 30*a*, 30*b*, and 30*c* of the upholstery material which face the cushion as illustrated in FIG. 12. An example of the adhesive used may be a contact adhesive.

Adhesive then is applied either to the rearwardly facing surfaces of marginal edge portions 30*c* of the upholstery material which face the front surface 26*a* of the back shell or to the surface of the back shell which will be engaged by portion 30*c* of the upholstery material. The combination cushion and upholstery layers then are pressed against the back shell to glue the assembly together in the region of marginal edge portions 30*c* of the upholstery material. The adhesive or glue used may be cyanoacrylate. As the parts are pressed together for gluing as illustrated in FIG. 12, rim 44 acts to prevent excess glue from escaping from the confines of the back shell.

The construction of the back as described allows it to consist of the back shell, cushion layer, and upholstery material only. This eliminates the need for an armature, which previously has been used, thus allowing the back to be made much thinner and providing better access for the operator in working on the patient.

Referring again to FIG. 4, support column 34 is a formed substantially rigid member having an outline configuration generally similar to the configuration of the central section of back shell 26. The support column has a face directed toward the back shell, a back directed away therefrom, a lower, or proximal, end, an upper, or distal, end and opposed elongate side edges. The lower, or proximal, portion of support column 34 is adapted to receive an upper portion of tilting arm 36 and has threaded bores 64 formed therein. Tilting arm 36 has bores 66 extending therethrough through which threaded fasteners may extend to be received in bores 64 on the support column 34 to secure the support column to the tilting arm and operating mechanism of the chair.

The support column also has four additional threaded bores 70 adapted to receive headed fasteners 72. The headed fasteners may be screws or bolts which are screwed into bores 70 with their heads projecting outwardly therefrom. With the support column securely mounted on tilting arm 36 and headed fasteners 72 received in bores 70, the back 14 may be easily and removably mounted thereon on support 34. This is done by placing keyhole-shaped receiving notches 46 over the heads of fasteners 72 and sliding the back downwardly to engage the headed fasteners in the reduced section portions of notches 46.

The support column also has an elongate upright channel 76 formed therein which is adapted to receive stem 20 on the head rest 16. Appropriate mechanism would be provided in the channel for permitting positioning of the head rest as desired.

While a preferred embodiment of the invention has been described herein, it should be apparent to those skilled in the art that variations and modifications are possible without departing from the spirit of the invention as set out in the following claims.

What is claimed:

1. A back for a patient chair in which a patient may be moved from a generally upright sitting position to a generally supine position, said back comprising:

a back shell having a front surface, back surface, top, bottom, opposed first and second outer sides, a central section extending longitudinally from a region adjacent said top to a region adjacent said bottom and opposed side sections extending laterally outwardly from said central section toward said first and second outer sides, said side sections being of sufficient rigidity to support portions of a patient in a supine position and being sufficiently flexible to allow deflection of a side section in the direction of said front surface from a selected normal position by application of force imposed on the side section in such direction and to return said side section to said normal position on release of such force; and a cushion overlying the face of said back shell;

wherein said central section is substantially rigid and comprises a plurality of stiffener ribs, and wherein said ribs extend longitudinally of said back shell.

2. The back of claim 1, wherein said central section is formed in a gentle S-shape to conform generally to a patient's spine.

3. The back of claim 1, wherein a portion of said back shell adjacent the top is generally straight extending from side to side and in a region below a horizontal mid-region said back shell has a trough-shaped center with laterally outwardly extending portions adjacent said first and second outer sides extending substantially perpendicular to a longitudinal centerline of said back shell.

4. The back of claim 1, wherein said ribs extend a major portion of the distance between the top and bottom of said back shell.

5. The back of claim 1, wherein said back shell is comprised of molded plastic having a thickness in a range of 0.135 to 0.190 inch and having a flexibility in a side section such that said side section may be flexed a distance of about 0.5 inch by a force of about 30 pounds imposed thereon.

6. The back of claim 1, wherein the upper section of the back shell has opposed top margin portions positioned to provide support for a patient's scapula, and a center top section between said top margin portions which is depressed to permit positioning of a headrest in the region between said opposed top margin portions.

7. The back of claim 1, wherein said central section is substantially rigid and has a selected width and said back shell has an overall side-to-side width at least twice said selected width.

8. A back for a patient chair in which a patient may be moved from a generally upright sitting position to a generally supine position, said back comprising:

a back shell having a front surface, back surface, top, bottom, opposed first and second outer sides, a central section extending longitudinally from a region adjacent said top to a region adjacent said bottom and opposed side sections extending laterally outwardly from said central section toward said first and second outer sides, said side sections being of sufficient rigidity to support portions of a patient in a supine position and being sufficiently flexible to allow deflection of a side section in the direction of said front surface from a selected normal position by application of force imposed on the side section in such direction and to return said side section to said normal position on release of such force; and a cushion overlying the face of said back shell, wherein said back shell comprises a keyhole shaped receiving notch for receiving a headed fastener for removably attaching said back shell to support structure in a chair.

9. The back of claim 8, wherein the back shell has an outer peripheral edge of a selected outline, and said cushion comprises a layer of resilient cushion material having front and back surfaces, with the back facing said back shell, and an outer edge margin contour substantially paralleling the outer peripheral edge of said back shell and projecting radially outwardly therefrom a selected distance, and a layer of upholstery material overlying said cushion material.

10. The back of claim 9, wherein said upholstery material overlies the face surface of said cushion material and has an edge margin portion which is wrapped around the outer edge margin of said cushion material to lie against a portion of the back of the cushion material adjacent the outer margin and is adhesively secured to the back surface of said cushion material.

11. The back of claim 10, wherein said edge margin portion of said upholstery material is adhesively secured to said back shell to secure said cushion to the back shell.

12. The back of claim 11, wherein an outer peripheral edge of said back shell has a lip projecting forwardly from remainder portions of said back shell to maintain adhesive between the upholstery material and the back shell within the confines of the back shell.

13. The back of claim 12, wherein said lip projects in a range of from 0.07 to 0.09 inch from remainder portions of said back shell.

14. The back of claim 10, wherein said upholstery material is adhesively secured to the face surface of said cushion material.

15. The back of claim 14, wherein the adhesive comprises contact adhesive.

16. The back of claim 9, wherein said front surface of the back shell has a selected topographic contour and said cushion material is pre-formed whereby the back surface of the cushion material is substantially complementary to the topographic contour of the front surface of the back shell.

17. The back of claim 16, wherein said upholstery material is pre-formed to the shape of the face surface and the outer marginal edge of said cushion material.

18. A chair for patient treatment having a chair back which may be reclined to place a patient in a generally supine position, said chair comprising:

an elongate support column having a proximal end, a distal end and a front surface, said column connected at its proximal end to mechanism on said chair allowing said column to be moved from a generally upright position to a position tilted rearwardly therefrom;

a back shell removably mounted at said front surface of said column, said back shell having a front surface of a selected topographic contour, back surface, top, bottom, and opposed first and second outer sides, said back shell having a central section extending longitudinally from a region adjacent said top to a region adjacent said bottom and opposed side sections extending laterally outwardly from said central section toward said first and second outer sides, said side sections being of sufficient rigidity to support portions of a patient in a supine position and being sufficiently flexible to allow deflection of a side section from a selected normal position in the direction of said front surface by application of a force imposed on the side section is such direction and to return said side section to said normal position on release of such force; and a cushion overlying the face of said back shell and having a back surface generally complementary to the topographic contour of the front surface of said back shell wherein said central section is substantially rigid and comprises a plurality of stiffener ribs and wherein said ribs extend longitudinally of said back shell.

19. The chair of claim 18, wherein said central section is formed in a gentle S-shape to conform generally to a patient's spine.

20. The chair of claim 18, wherein the top is generally straight extending from side to side and in a region below a horizontal mid-region said back shell has a trough-shaped center contour with laterally outwardly extending portions adjacent said first and second outer sides extending substantially perpendicular to a longitudinal centerline of said back shell.

21. The chair of claim 18, wherein said ribs extend a major portion of the distance between the top and bottom of said back shell.

22. A chair for patient treatment having a chair back which may be reclined to place a patient in a generally supine position, said chair comprising:

an elongate support column having a proximal end, a distal end and a front surface, said column connected at its proximal end to mechanism on said chair allowing said column to be moved from a generally upright position to a position tilted rearwardly therefrom;

a back shell removably mounted at said front surface of said column, said back shell having a front surface of a selected topographic contour, back surface, top, bottom, and opposed first and second outer sides, said back shell having a central section extending longitudinally from a region adjacent said top to a region adjacent said bottom and opposed side sections extending laterally outwardly from said central section toward said first and second outer sides, said side sections being of sufficient rigidity to support portions of a patient in a supine position and being sufficiently flexible to allow deflection of a side section from a selected normal position in the direction of said front surface by application of a force imposed on the side section is such direction and to return said side section to said normal position on release of such force; and a cushion overlying the face of said back shell and having a back surface generally complementary to the topographic contour of the front surface of said back shell, wherein said support column has a headed fastener projecting from the front of said column and said back shell comprises a keyhole shaped receiving notch for receiving said headed fastener.

23. The chair of claim 22, wherein the back shell has an outer peripheral edge of a selected outline, and said cushion comprises a layer of resilient cushion material having front and back surfaces, with the back facing said back shell, and an outer edge margin contour substantially paralleling the outer peripheral edge of said back shell and projecting radially outwardly therefrom a selected distance, and a layer of upholstery material overlying said cushion material.

24. The chair of claim 23, wherein said upholstery material overlies the face surface of said cushion material and has an edge margin portion which is wrapped around the outer edge margin of said cushion material to lie against a portion of the back of the cushion material adjacent the outer edge margin and is adhesively secured to the back surface of said cushion material.

25. The chair of claim 24, wherein said edge margin portion of said upholstery material is adhesively secured to said back shell to secure said cushion to the back shell.

26. The chair of claim 25, wherein an outer peripheral edge of said back shell has a lip projecting forwardly from remainder portions of said back shell to maintain adhesive between the upholstery material and the back shell within the confines of the back shell.

27. The chair of claim 26, wherein said lip projects in a range of from 0.07 to 0.09 inch from remainder portions of said back shell.

28. The chair of claim 24, wherein said upholstery material is adhesively secured to the face surface of said cushion material.

29. The chair of claim 25, where in the adhesive comprises cyanoacrylate.

30. The chair of claim 23, wherein said cushion material is pre-formed whereby the back surface of the cushion material is substantially complementary to the face of the back shell.

31. The chair of claim 30, wherein said upholstery material is pre-formed to the shape of the face surface and the outer marginal edge of said cushion material.

32. The chair of claim 22, wherein said back shell is comprised of molded plastic having a thickness in a range of 0.135 to 0.190 inch and having a flexibility in said side section such that said side section may be flexed a distance of about 0.5 inch by a force of about 30 pounds imposed thereon.

33. The chair of claim 22, which further comprises a headrest mounted on said support column for raising and lowering relative to the top of the back shell and wherein the upper section of the back shell has opposed top margin portions positioned to provide support for a patient's scapula, and a center top section between said top margin portions which is depressed to permit positioning of the headrest in the region between said opposed top margin portions.

34. The chair of claim 22, wherein said central section is substantially rigid and has a selected width and said back shell has an overall side-to-side width at least twice said selected width.

* * * * *

UNITED STATES PATENT AND TRADEMARK OFFICE

CERTIFICATE OF CORRECTION

PATENT NO. : 7,290,836 B2
APPLICATION NO. : 10/855031
DATED : November 6, 2007
INVENTOR(S) : Carl G. Nordstrom et al.

It is certified that error appears in the above-identified patent and that said Letters Patent is hereby corrected as shown below:

In the Claims:

Column 8, line 49, "section is such" should read --section in such--.

Column 9, line 25, "section is such" should read --section in such--.

Signed and Sealed this

Twelfth Day of August, 2008

JON W. DUDAS
*Director of the United States Patent and Trademark Office*